US011859460B2

(12) United States Patent
Pliska

(10) Patent No.: US 11,859,460 B2
(45) **Date of Patent: *Jan. 2, 2024**

(54) GRAVITY ACTUATED CONNECTION MECHANISM FOR HIGH PRESSURE WELLHEAD APPLICATIONS

(71) Applicant: CROWN OIL TOOLS LLC, Humble, TX (US)

(72) Inventor: Ross Pliska, Rock Hill, SC (US)

(73) Assignee: CROWN OIL TOOLS LLC, Humble, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/962,100

(22) Filed: Oct. 7, 2022

(65) Prior Publication Data

US 2023/0105282 A1 Apr. 6, 2023

Related U.S. Application Data

(63) Continuation of application No. 17/233,837, filed on Apr. 19, 2021, now Pat. No. 11,473,386.

(60) Provisional application No. 63/021,388, filed on May 7, 2020.

(51) Int. Cl.
*E21B 33/03* (2006.01)
*E21B 23/00* (2006.01)

(52) U.S. Cl.
CPC ..... *E21B 33/03* (2013.01); *E21B 23/006* (2013.01)

(58) Field of Classification Search
CPC ..... E21B 33/03; E21B 23/006; E21B 33/035
See application file for complete search history.

(56) References Cited

U.S. PATENT DOCUMENTS

| | | | |
|---|---|---|---|
| 2,076,918 | A | 4/1937 | Robison |
| 2,673,751 | A | 3/1954 | Finch |
| 3,170,667 | A | 2/1965 | Szohatzky |
| 3,516,703 | A | 6/1970 | Templeton |
| 5,403,043 | A | 4/1995 | Smet |
| 5,782,058 | A | 7/1998 | Chadwick |
| 6,409,221 | B1 | 6/2002 | Robinson et al. |
| 9,644,443 | B1 | 5/2017 | Johansen et al. |
| 10,550,659 | B2 | 2/2020 | Kibler et al. |

(Continued)

FOREIGN PATENT DOCUMENTS

WO 2012/028838 A2 3/2012

*Primary Examiner* — James G Sayre
(74) *Attorney, Agent, or Firm* — Finch & Maloney PLLC

(57) ABSTRACT

A pressurizable assembly which comprises first and second assemblies. The first assembly has a plurality of cam grooves while the second assembly is size and shaped to intimately receive and mate with the first assembly. The second assembly has a connection member a plurality of radially mounted locking pin mechanisms for interacting with one of the plurality of spaced apart cam grooves. Axial movement of the second assembly, toward and away from the first assembly, causes the plurality of locking pin mechanisms to follow along the cam grooves to an intermediate locking position which locks the second assembly with the first assembly, while a subsequent axial movement of the second assembly, toward and away from the first assembly, causes the plurality of locking pin mechanisms to follow along the plurality of cam grooves and disengage the second assembly from the first assembly.

13 Claims, 16 Drawing Sheets

(56) References Cited

U.S. PATENT DOCUMENTS

| | | | | |
|---|---|---|---|---|
| 11,473,386 | B2 * | 10/2022 | Pliska | E21B 33/035 |
| 2016/0084027 | A1 | 3/2016 | Silva et al. | |

* cited by examiner

GRAVITY ACTUATED CONNECTION MECHANISM FOR HIGH PRESSURE WELLHEAD APPLICATIONS

FIELD OF THE INVENTION

The present invention relates to the connection and disconnection of pressure control equipment at the wellhead of a subterranean well. More specifically, the present invention addresses the need to provide safe connections at the wellhead without the need for human intervention—either directly or remotely—to activate the locking mechanism other than the hoisting equipment and hoisting equipment operator already commonly employed in the installation of such equipment.

BACKGROUND OF THE INVENTION

In the course of constructing, operating and servicing subterranean oil and gas wells, it is necessary to connect and disconnect various types of equipment to the top of the well commonly referred to as the wellhead. The device can be attached directly to the wellhead, a valve, spool, or any other part of the well's surface equipment but will henceforth be referred to as simply the wellhead. This connection is accomplished most commonly by hoisting the equipment into position above the wellhead while one or more human operators manually connect the equipment using flanges, quick unions or other mechanical locking devices. To achieve this, humans are required to spend a significant amount of time in close physical proximity to the wellhead near dangerous highly pressurized equipment, often referred to as the "pressure zone". This presents a significant safety risk for the operators as well mental and physical stress associated with operating heavy manual equipment in a risk-elevated space.

More recently, products have been developed that allow operators to achieve high pressure connections while operating the equipment remotely. Various designs have been employed that utilize hydraulic or other mechanical means to activate a locking mechanism once the equipment has been hoisted into place. These remote activation devices can be operated either outside of the pressure zone or by the crane operator, however, they still employ a human remote operator and an external power source to achieve the high pressure seal. Thus, these complex systems leave open the potential for human error and expose the operator to a significantly higher economic burden.

Some known patents relating to this subject matter are, for example, U.S. Pat. Nos. 5,782,058A, 3,170,667A, 6,409,221B1, 2,673,751A, 2,076,918A, 5,403,043A, 9,644,443B1 and 10,550,659B2.

All previous methods have employed the use of human activation and external power sources, therefore there remains an unmet need in the well services sector for a mechanism to achieve high pressure seals using only the force of gravity and the hoisting equipment already used to position the equipment in place.

SUMMARY OF THE INVENTION

Where it is an object of the present invention to overcome the above mentioned shortcomings and drawbacks associated with the prior art to provide a safe, reliable means of creating a high pressure fluid connection at the wellhead without the use of direct human intervention and without the need for any person to enter the pressure zone. This is accomplished by using only the crane or other hoisting equipment already commonly used to situate the equipment on or near the wellhead and the force of gravity. The present invention includes a fitting attached to the upper end of the wellhead and a mating fitting attached to the lower end of the pressure control equipment being coupled onto the wellhead. The two fittings are constructed with a unique cam groove machined into either the upper or lower fitting which, when paired with a mating "locking pin" in the opposite fitting, trace a radial and axial path that will reliably achieve a high pressure connection simply by lowering the upper fitting onto the lower fitting and subsequently pulling the upper fitting upward with the hoist. The connection can then be broken by again simply lowering the upper fitting back down and subsequently raising the upper fitting using the hoist to separate the upper and lower fitting from one another and break the high pressure connection. Thus, a safe, reliable, high-pressure connection can be made and broken using only the downward force of gravity and the upward force of the crane. This achieves the object of removing the need for human intervention in the pressure zone thereby greatly reducing potential health and safety hazards.

Another object of the present invention is to remove the necessity of remote operation personnel and/or equipment as used by currently available remotely activated sealing mechanisms. Remotely activated systems often still rely on human activation which inherently introduces more potential safety risks due to human error. In addition, such personnel and equipment can be very complex and have a high cost associated with their use. The present invention makes use of a simpler mechanism that will only rely on the hoisting equipment operator—who is already necessary with all current systems—and the force of gravity. There is no external equipment necessary outside of the crane or the hoisting equipment already in use to ensure that a safe and reliable connection is achieved thereby reducing the potential of human error, mechanical malfunction, and/or elevated cost.

A further object of the present invention is to improve the speed with which high pressure equipment can be attached to or removed from a wellhead. Current methods for connecting pressure control equipment require the crane operator to first hoist the equipment into place and then require additional actions to be undertaken, either through direct human interaction or remote operation, for a proper connection to be made. The present invention removes the need for the additional steps of activation as the crane operator simply hoists the equipment to be connected into place and then lifts up on the equipment, thus significantly improving the efficiency of the connection and disconnection processes.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE PREFERRED EMBODIMENTS

The present invention will be understood by reference to the following detailed description, which should be read in conjunction with the appended drawings. It is to be appreciated that the following detailed description of various embodiments is by way of example only and is not meant to limit, in any way, the scope of the present invention.

Figure 1:
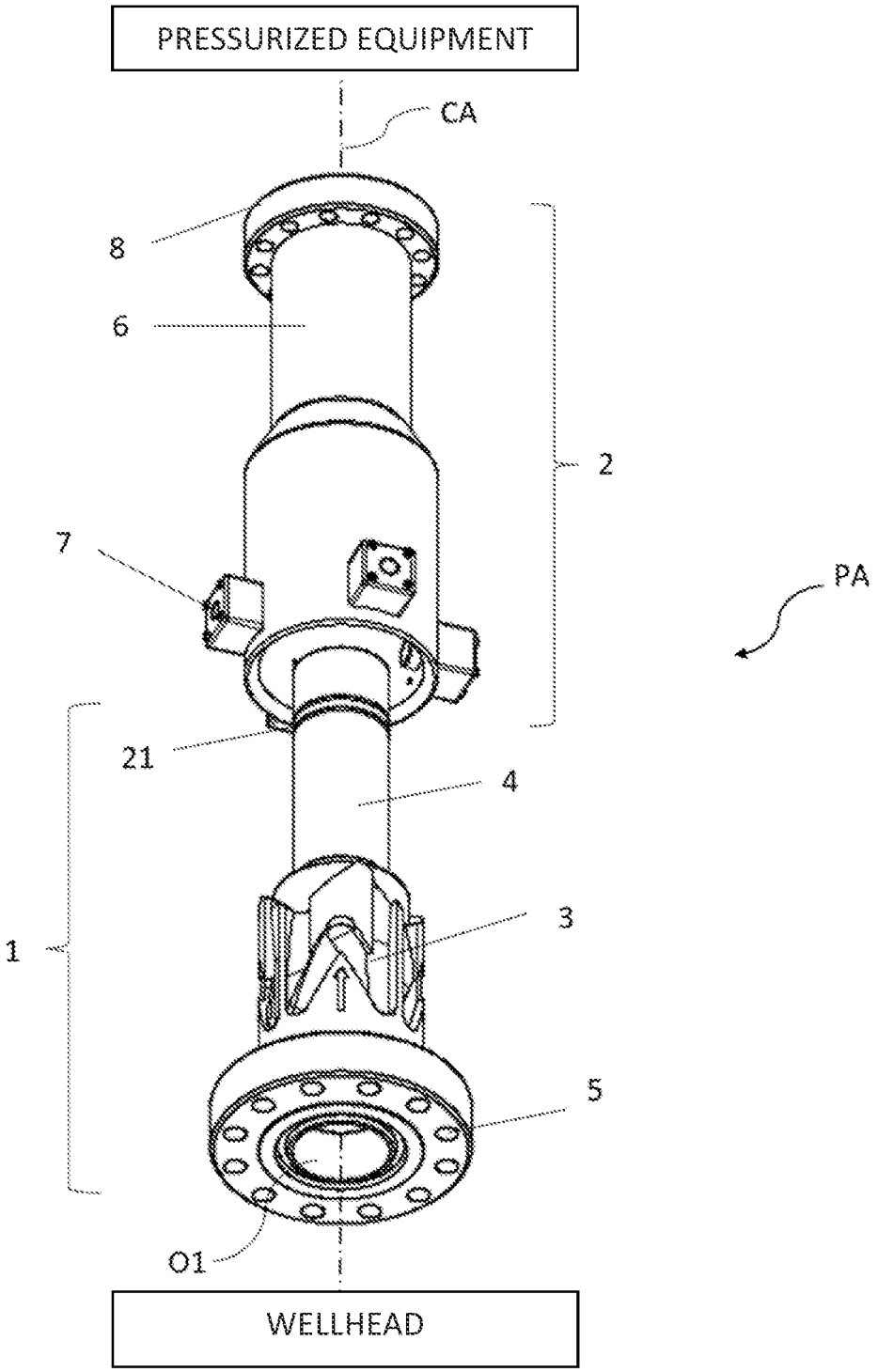
FIG. 1 is a perspective view of the second upper and the first lower fittings illustrating the major components of the invention.

Turning now to FIG. 1, a description concerning the various components of the present invention will now be briefly discussed. As can be seen in this embodiment, the present invention relates to two fitting/assemblies—a first lower assembly 1 and a second upper assembly 2 which, when assembled with one another as discussed below in further detail, form a fluid connection of a pressurizable assembly PA (see FIGS. 8 and 13, for example). The first lower assembly 1 has a tubular section 4 which supports one or more elastomeric seals 21 which will form a seal with a mating tubular section of the second upper assembly 2 once the upper and lower assemblies 1, 2 properly engage with one another, as discussed below in further detail.

Figure 3:
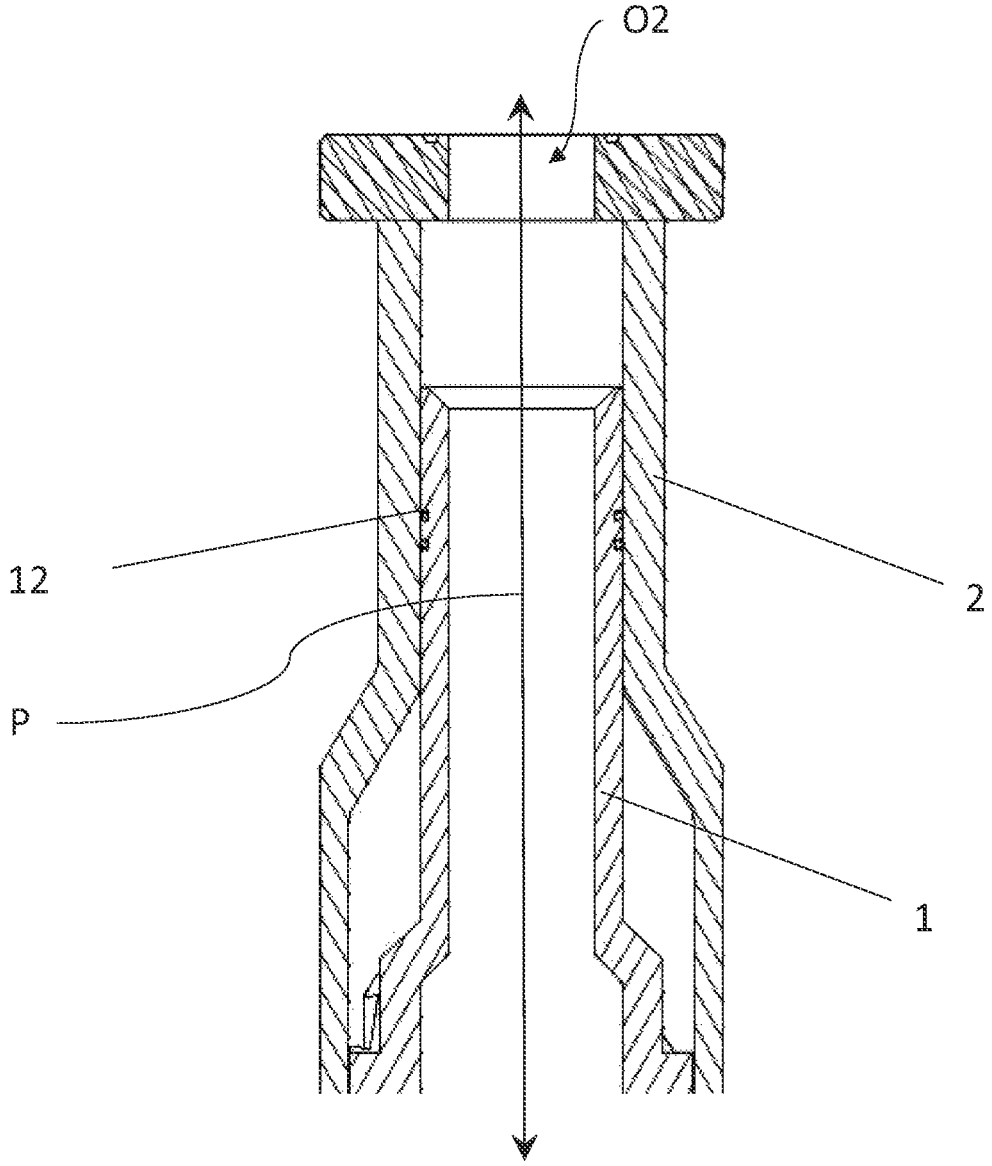
FIG. 3 is a diagrammatic section view of the radial seal used to achieve a high-pressure fluid connection in the flow passage formed by the second upper and first lower fittings/assemblies.

The first lower assembly 1 has a conventional lower connection member 5 which facilitates connection of the first lower assembly 1 to the wellhead in a conventional manner as well as a plurality or series of spaced apart cam grooves 3 formed in an exterior surface the first lower assembly 1. The lower connection member 5 has a central opening O1 formed therein which permits a fluid to flow into and out of the first lower assembly 1. It is to be appreciated that the lower connection member 5 can incorporate different types of connections to allow the first lower assembly 1 to be affixed to the wellhead but is shown here as a conventional flange for illustrative purposes only. The second upper assembly 2 has a hollow housing 6 which has an internal diameter which is size and shaped to intimately receive and mate with the tubular section 4 of the first lower assembly 1. As shown in FIG. 3, the hollow housing 6 has a tapered section (not numbered) which reduces the diameter of the hollow housing 6. This taper assists with properly aligning the tubular section 4 of the first lower assembly 1 with the reduced diameter section of the second upper assembly 2 so as to achieve a fluid tight seal therebetween with the assistance of the elastomeric seals 21 (see FIG. 3).

In addition, the second upper assembly 2 has a plurality or series of radially mounted locking pin mechanisms 7, e.g., four equally spaced apart locking pin mechanisms, and a conventional upper connection member 8 which facilitates connection of the second upper assembly 2 to a desired piece of pressure equipment. The upper connection member 8 has a central opening O2 formed therein which permits a fluid to flow into and out of the second upper assembly 2 and communicate with the tubular section 4. As with the first lower assembly 1, the upper connection member 8, supported at the top of the second upper assembly 2, can have a variety of different designs such as (but not limited to) a flange, a quick union, or some other threaded union. However, for illustrative purposes, a flange is depicted in this figure. Once the first lower assembly 1 is properly connected to the second upper assembly 2, a desired fluid passageway (shown by double arrow P in FIG. 3) is formed by the pressurizable assembly PA which permits a fluid, e.g., water, liquid or gas, to flow between the desired piece of pressure equipment and the wellhead, as is conventional in the art.

Figure 2:
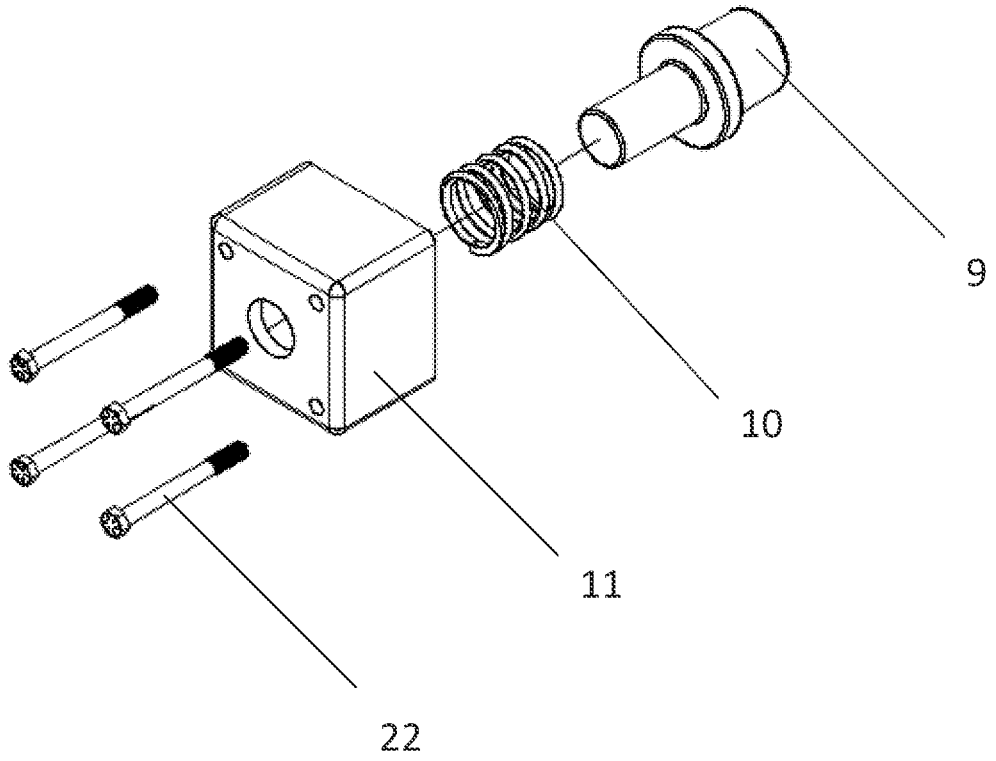
FIG. 2 is an exploded view of the locking pin mechanism.

FIG. 2 is an exploded view of the locking pin mechanism 7 which comprises a locking pin 9, a compression spring 10 and a pin housing 11 which accommodates those components. As shown, a rear surface of the pin housing 11 has a through bore extending therethrough which accommodates a trailing end of the respective locking pin 9. The assembly housing 6 has a mating through bore (not shown in detail) though which the leading end of each locking pin 9 projects while an associated collar, of each locking pin 9, is larger in diameter than the diameter of the respective through bore, in the assembly housing 6, so as to prevent the locking pin 9 from passing completely therethough. When the respective locking pin 9 is inserted through the respective through bore of the assembly housing 6 and the trailing end of the locking pin 9 is accommodated by pin housing 11 with the spring 10 in a compressed state located between the pin housing 11 and the collar of the locking pin 9, the spring 10 generates a force which pushes the locking pin 9 radially inward toward a longitudinal central axis CA defined by the pressurizable assembly C. As shown, a plurality of bolts 22 (e.g., four bolts) secure each pin housing 11 to the exterior surface of the assembly housing 6 of the second upper assembly 2. The spring 10 functions to constantly and continuously urge the locking pin 9 radially inward toward the central axis CA of the pressurizable assembly PA.

Turning now to FIG. 3, once the upper and lower assemblies 1, 2 are properly fitted together, a fluid tight seal is formed therebetween due to the close tolerance fit between the tubular section 4 and the reduced diameter section of the hollow housing 6 and the elastomeric seals 21. In this Figure, the elastomeric seals comprise two O-rings 12 with a circular cross-section. However there are alternate designs that could be utilized to achieve the desired seal and still fall within the spirit and scope of the present invention. In the depicted embodiment, the first lower assembly 1 would be attached to the wellhead and the second upper assembly 2 would be attached to the pressure control equipment or some other equipment desired to be attached to the wellhead. The pressure control equipment or other equipment, in turn, would be attached to a conventional crane or hoisting device to facilitate the desired vertically upward and downward movement of the second upper assembly 2 relative to the first lower assembly 1, as discussed below in further detail. When the crane or hoisting device lowers the second upper assembly 2 onto and into engagement with the first lower assembly 1, the two assemblies 1, 2, engage with one another and create a fluid tight seal for the flow passage P. The achieved fluid tight seal of the pressurizable assembly PA is not limited to but is generally assumed to be suitable for a working pressure of 10 ksi or greater.

Figure 4C:
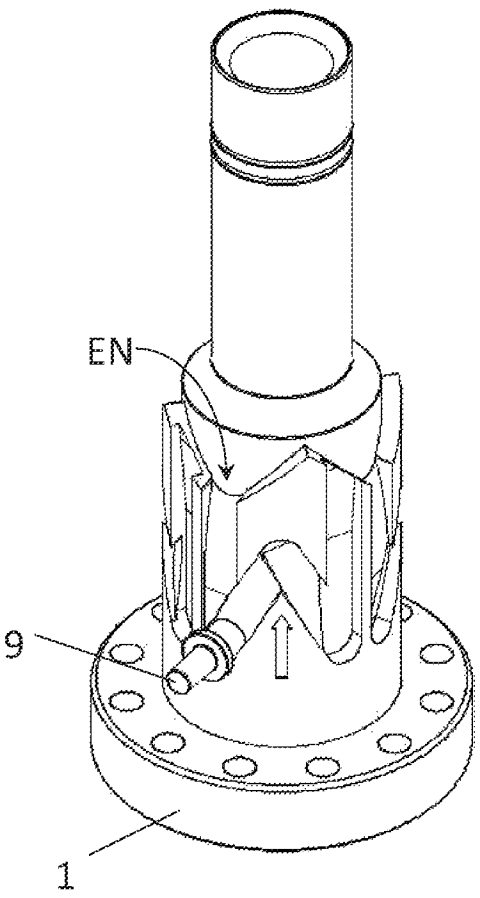
FIGS. 4A through 4C are diagrammatic perspective assembly views illustrating the sequential movement of the locking pin through the cam groove during the "entry" phase of achieving the connection between the second upper fitting/assembly and the first lower fitting/assembly, with most of the second upper fitting/assembly being removed for reasons of clarity.
Figure 4B:
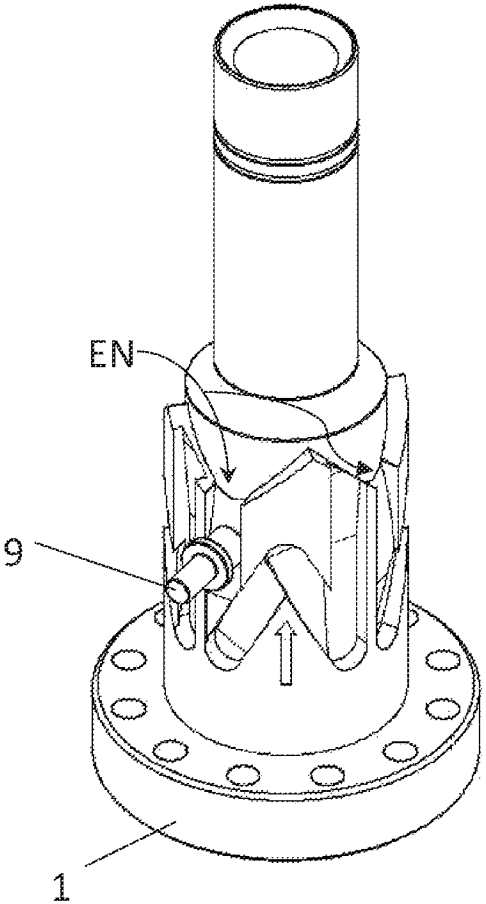
Figure 4A:
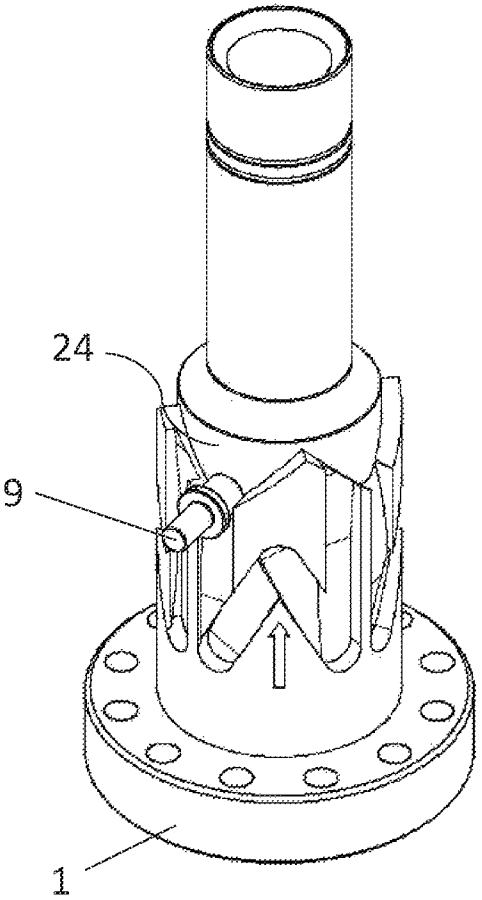

FIG. 4A through 4C illustrate the interaction between the locking pin 9 (only one of which is shown in these figures) and a respective cam groove 3 as the crane lowers the second upper assembly 2 (which may be attached to the pressure control equipment) onto the first lower assembly 1 (which may be attached to the wellhead). In order to clearly visualize the inner workings of the locking mechanism, the remaining components of the second upper assembly 2, are removed and only a single one of locking pins 9 is shown. FIGS. 4A-4C show how locking pin 9, which is constantly being forced radially inward by the respective spring 10, is gradually directed toward and enters through the entrance EN of the respective cam groove 3 as the crane lowers the second upper assembly 2 toward the first lower assembly 1.

Figure 5A:
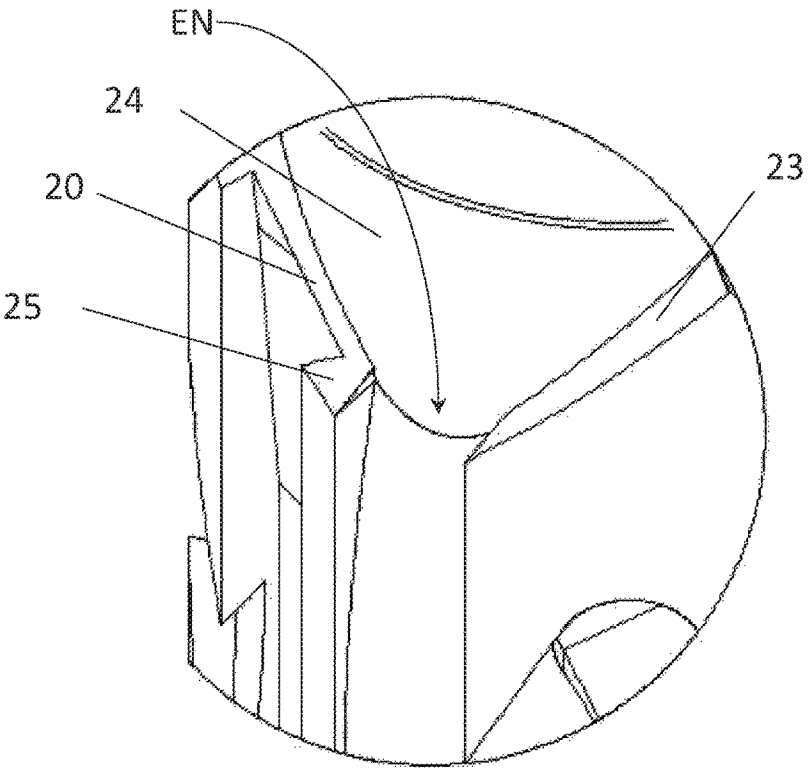
FIG. 5A is an enlarged view of detail A in FIG. 5.
Figure 5:
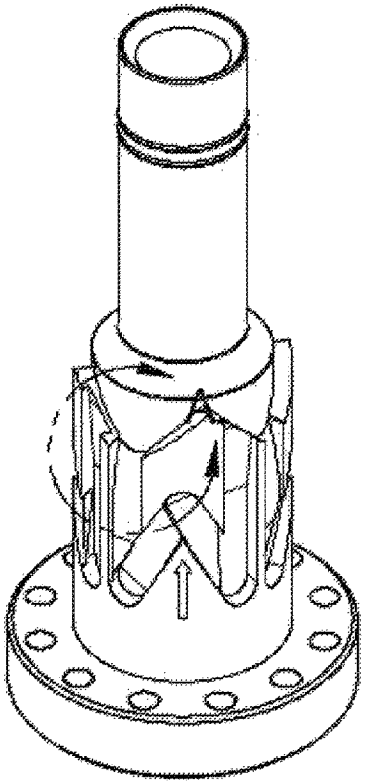
FIG. 5 is a perspective view showing the top of the entry region of the cam groove.

FIG. 5 shows a detailed view of the uppermost portion of each respective cam groove 3 and a clearer view of how the shape and surface profile of the second upper assembly 2 assists with guiding each one of the locking pins 9 toward the entrance EN of the respective cam grooves 3 as the second upper assembly 2 is lowered into engagement with the first lower assembly 1. As stated above, the spring 10 constantly forces the locking pin 9 radially inward toward the central axis A. The inwardly facing surface of the locking pin 9 is forced against the outer generally cylindrical surface 24 of the first lower assembly 1, as generally shown in FIG. 4A. As second upper assembly 2 is lowered toward the first lower assembly 1, the cylindrical surface 24 and the pair of V-shaped pin guide surfaces 23 and 25 assist with directing and channeling the locking pin 9 toward the entrance EN of the respective cam groove 3 (see FIG. 5).

After the pair of V-shaped pin guiding surfaces 23 and 25 directed the locking pin 9 into the entrance EN of the respective cam groove 3, the locking pin then follows along the first cam segment 13 of the cam groove 3 as the second upper assembly 2 is lowered into engagement with the first lower assembly 1. FIGS. 4A-4C the sequence of positions that the locking pin 9 follows while moving along the first cam segment 14 before eventually reaching the end of the first cam segment 13.

Figure 6A:
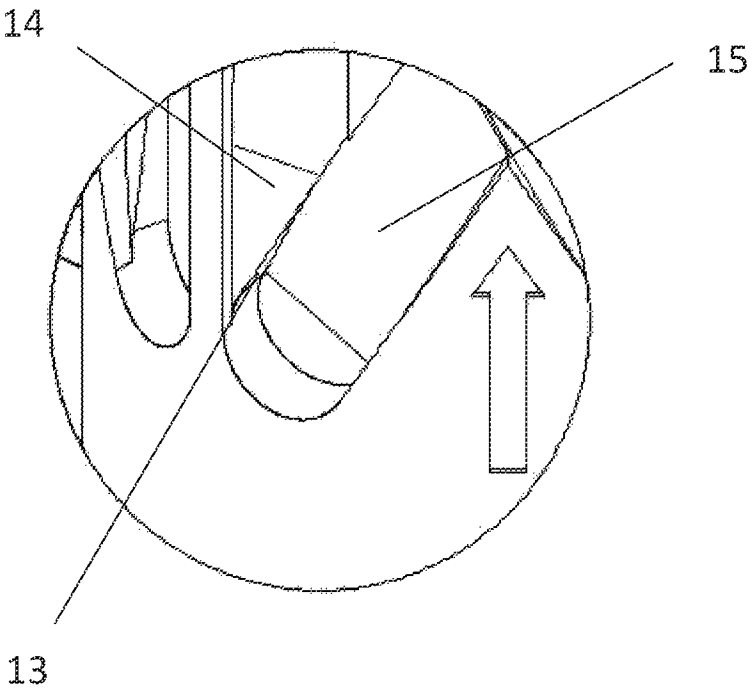
FIG. 6A is an enlarged view of detail A in FIG. 6.
Figure 6:
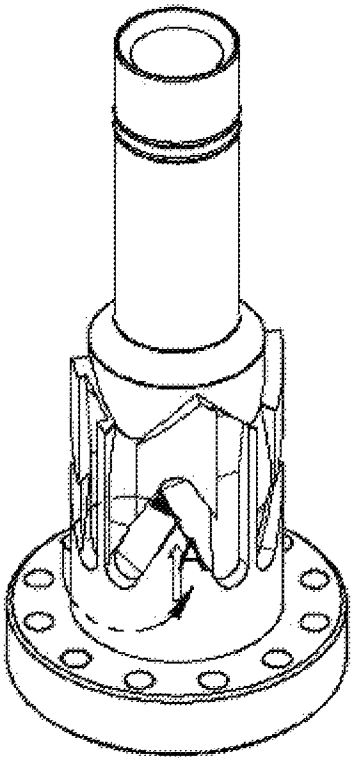
FIG. 6 is a perspective view showing the vertically lowermost section of the entry segment of the cam groove.

Turning now to FIG. 6, a first step 13 is located at a transition between the end of the first cam segment 14 and the beginning of the second cam segment 15. That is, the end of the first cam segment 13 is located slightly further away from the central axis CA than the beginning to the second cam segment 15 so that the first step 13, e.g., a radially inward step of between 1/16 to 1 inch or so and more preferably a step of about ½ of an inch, is formed between the end of the first cam segment 14 and beginning of the second cam segment 15. Since the locking pin 9, which is constantly forced radially inward, as the locking pin 9 passes or transitions from the end of the first cam segment 13 to the beginning of the second cam segment 15, the locking pin 9 passes over the first step 13. Once the locking pin 9 is completely located within the beginning of the second cam segment 15, the spring 10 forces the locking pin 9 radially inward a small distance, e.g., the thickness or height of the first step 13. As a result of this, the first step 13 now prevents the locking pin 9 from again following along the first cam segment 14 of the cam groove 3. As such, the first step 13 functions to prevent the respective locking pin 9 from retracing its path upward along the first cam segment 14 of the cam groove 3. Accordingly, when the crane again exerts a lifting force of the second assembly 3, the locking pin 9 will thus be forced to travel diagonally and follow along the second cam segment 15 of the cam groove 3 until the locking pin 9 eventually reaches position the position shown in FIG. 7C. That is, the first step 13 ensures, as soon as the locking pin 9 completely transitions into the second cam segment 15, that any subsequent upward force, from the crane, will cause locking pin 9 to travel along the second cam segment 15 of the cam groove 3 to the position shown in FIG. 7C and not back toward the entrance EN of the cam groove 3.

Figure 7C:
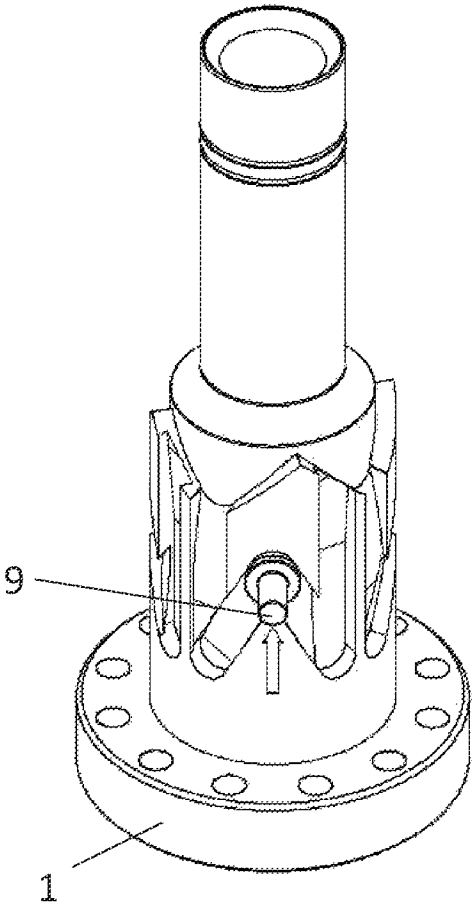
FIGS. 7A through 7C are perspective assembly views illustrating the diagonal sequential movement of the locking pin along the second segment of the cam groove during the second phase of connection to achieve the locked position of the pressurizable assembly.
Figure 7B:
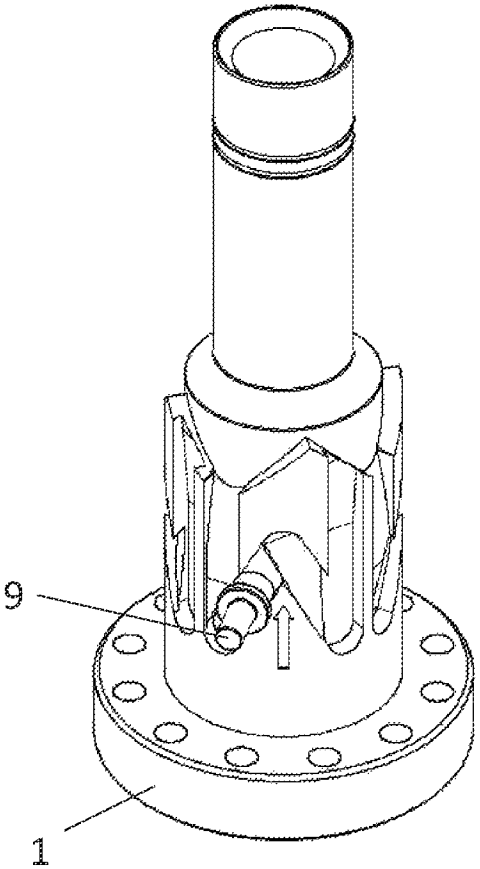
Figure 7A:
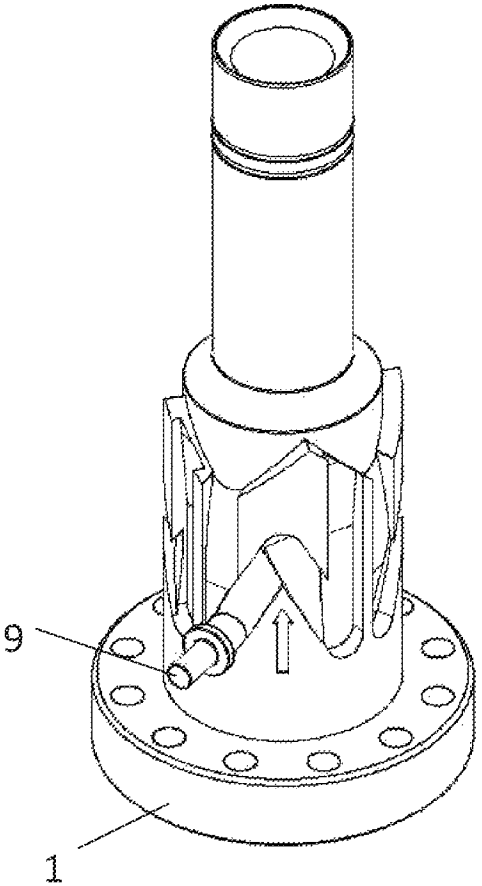
Figure 7E:
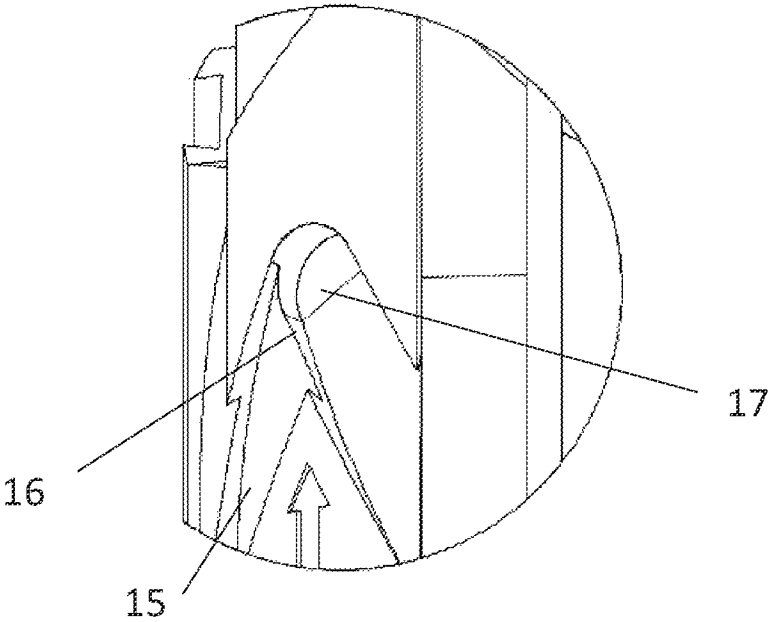
FIG. 7E is an enlarged view of detail A in FIG. 7D.

FIG. 7A through 7C illustrate the interaction between locking pin 9 and the cam groove 3 as the crane now begins to move the second upper assembly 2 relative to the first lower assembly 1. After the second upper assembly 2 is lowered to its bottom most position and the weight of the second upper assembly 2 is partially or fully transferred to the wellhead to permit the transition of the locking pin 9 to occur, the crane operator then lifts up on the second upper assembly 2 to move the locking pin 9 to engage and lock the connection. As a result of such movement, the locking pin 9 now travels, as indicated, along a diagonal path into the locked position shown in FIG. 7C.

Figure 7D:
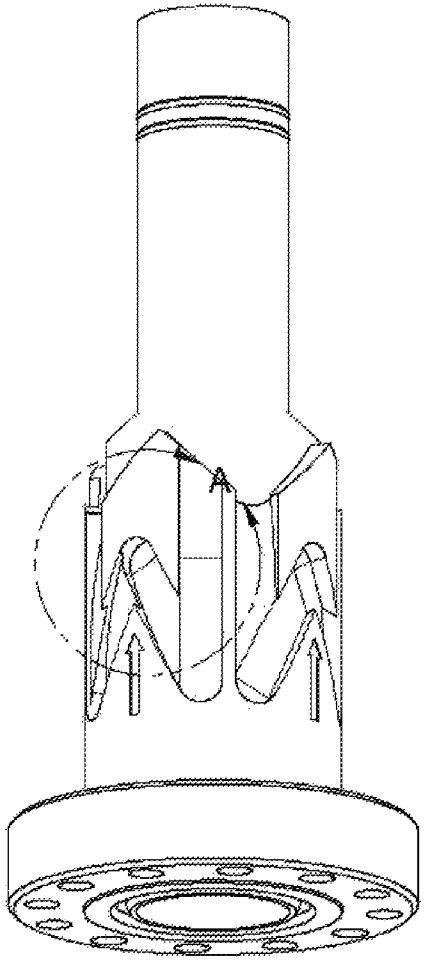
FIG. 7D is a perspective view showing the intersection of the second and the third segments of the cam groove where the locking pin is retained while the pressurizable assembly is retained in its locked position by upward force from the crane.

FIG. 7D shows the detail of cam groove 3 at the end of the second cam segment 15 and the beginning of the third cam segment 17. As shown, a second step 16, e.g., a radially inward step of between 1/16 to 1 inch or so and more preferably a step of about ½ of an inch, is located at the transition between the end of the second cam segment 15 and the beginning of the third cam segment 17 of the cam groove 3. That is, the end of the second cam segment 15, adjacent the beginning of the third cam segment 17, is located radially further away from the central axis CA than the beginning of the third cam segment 17 so as to form a step therebetween. As the second upper assembly 2 is lifted by the crane, the locking pin 9 eventually passes or transitions over the second step 15, located between the second and the third cam segments 15, 17 of the cam groove 3. Once the locking pin 9 is completely located within the beginning of the third cam segment 17, the spring 10 forces the locking pin 9 radially inward a small distance, e.g., the thickness or the height of the second step 16. As a result of this, the second step 16 now prevents the locking pin 9 from again following along the second cam segment 15 of the cam groove 3. As such, the second step 16 functions to prevent the respective locking pin 9 from retracing its path downward along the second cam segment 15 of the cam groove 3. Accordingly, when the crane again exerts a lowering force on the second assembly 2, the locking pin 9 will thus be forced to travel diagonally and follow along the third cam segment 17 of the cam groove 3 until the locking pin 9 eventually reaches position the position shown in FIG. 9C. That is, the second step 16 ensures, as soon as the locking pin 9 completely transitions into the third cam segment 17, that any subsequent downward force, from the crane, will cause locking pin 9 to travel along the third cam segment 17 of the cam groove 3 to the position shown in FIG. 9C and not back toward the position shown in FIG. 4C.

When the locking pin 9 is located in the position shown in FIG. 7C, the second upper and first lower assemblies 1, 2 are locked together in a way that can withstand the axial forces generated by the high internal pressure created within the connection between the first lower and second upper assemblies 1, 2. As long as tension is exerted axially in the form of an upward lifting force from the crane or other hoisting equipment, the locking pin 9 cannot move up or down along the cam groove 3.

Figure 8:
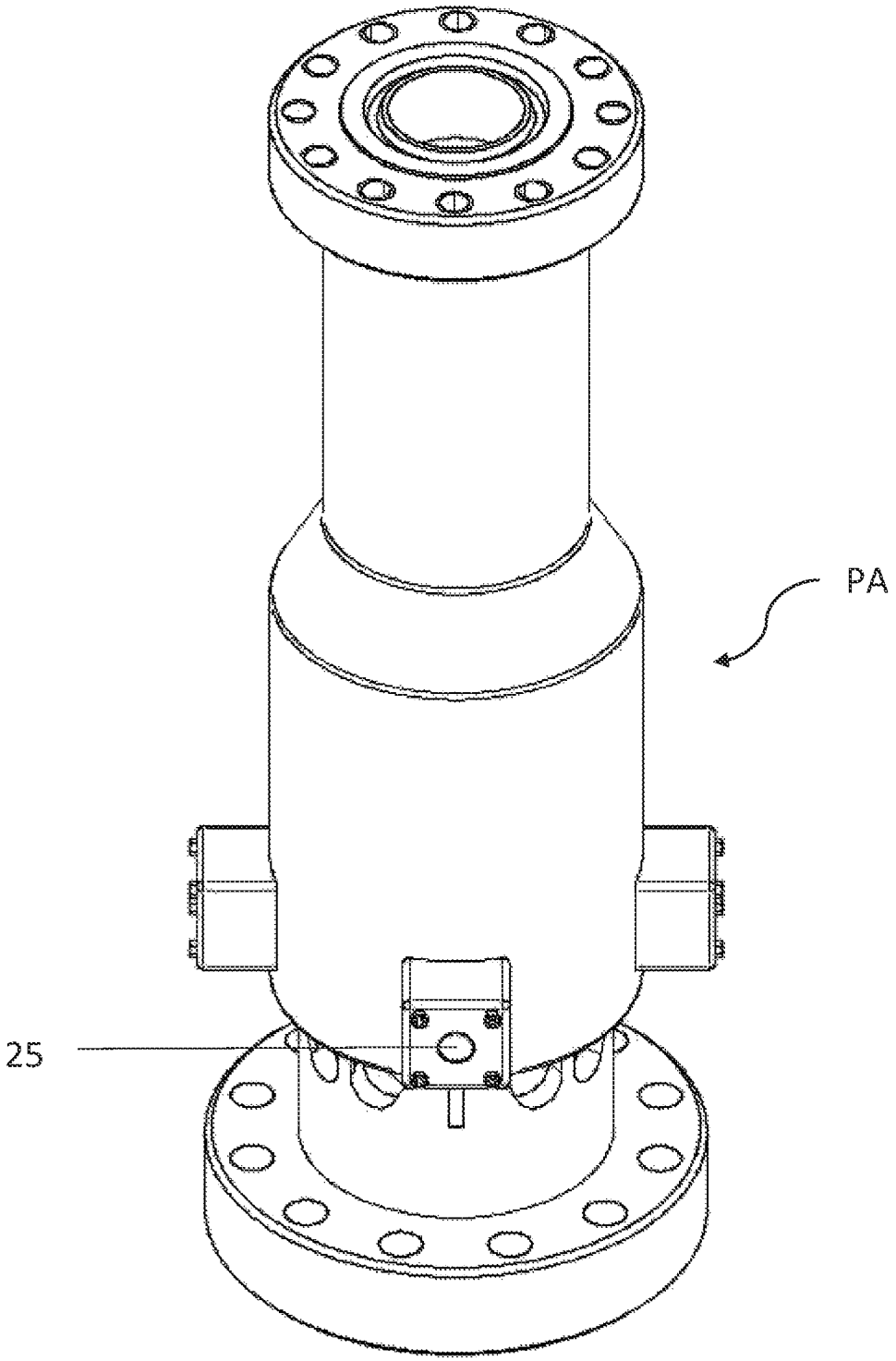
FIG. 8 is a perspective view of the pressurizable assembly shown in the connected and locked configuration.

Turning now to FIG. 8, this figure shows the fully locked position of the present invention. This figure shows the position of the pressurizable assembly PA with all four locking pins 9 engaged so as to create an axial link capable of withstanding maximum working pressures of more than 10 ksi, for example. This figure also illustrates that the locking pins 9 function as visual indicators signifying that the locking pins 9 are in there proper locked positions. That is, when the locking pins are fully depressed by the springs 10 radially inward in the locked position of FIG. 7C for example, the rear surface 25 of the locking pin 9 will be generally fully retracted into the locking pin housing and thus generally not visible to an operator thereby providing a visual feedback that the mechanism is fully engaged and locked.

Figure 9C:
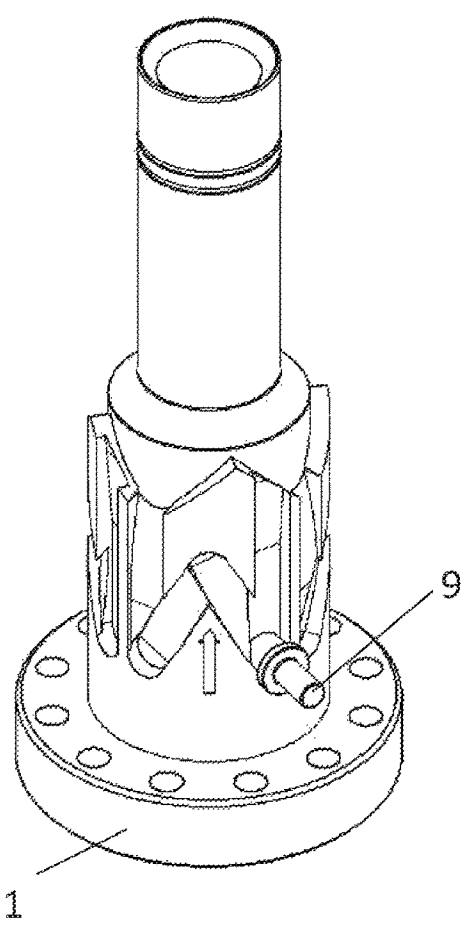
FIGS. 9A through 9C are perspective assembly views illustrating the diagonal sequential movement of the locking pin along the third segment of the cam groove during the first phase of disconnection.
Figure 9B:
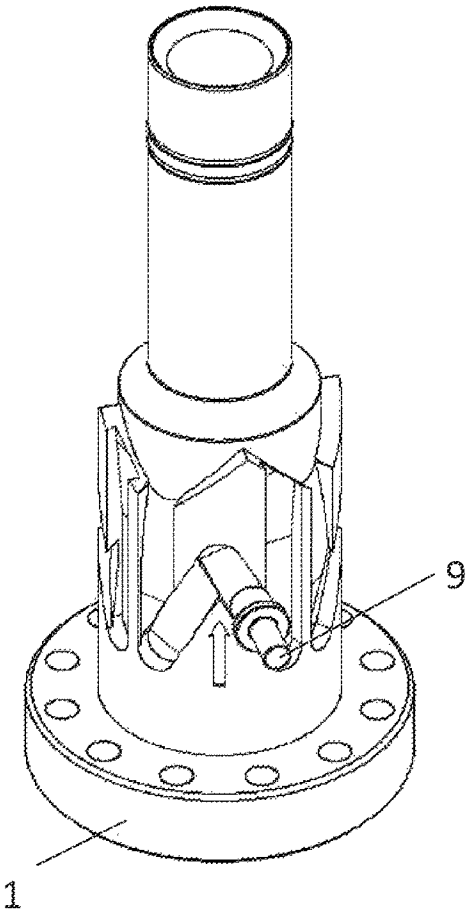
Figure 9A:
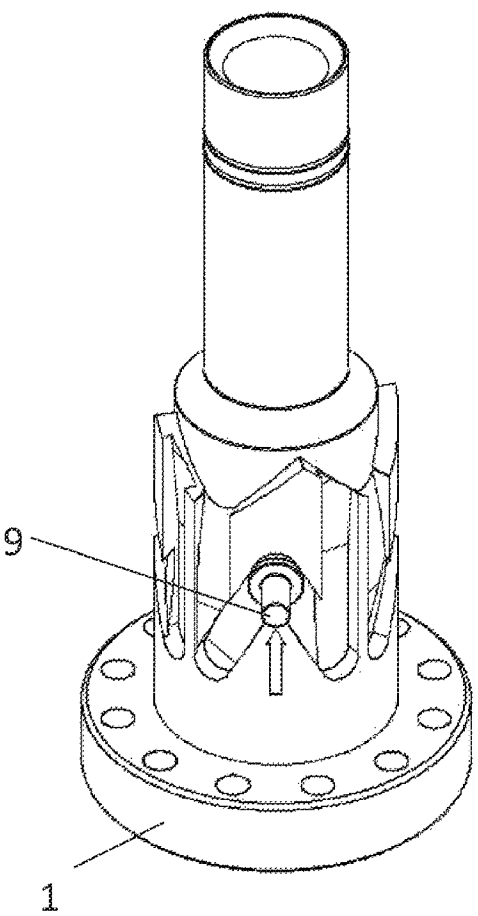
Figure 9E:
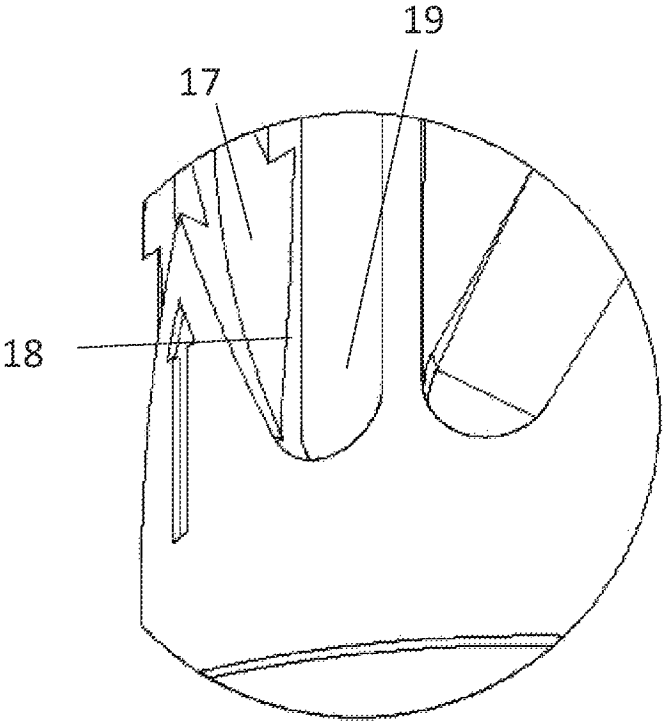
FIG. 9E is an enlarged view of detail A in FIG. 9D.
Figure 9D:
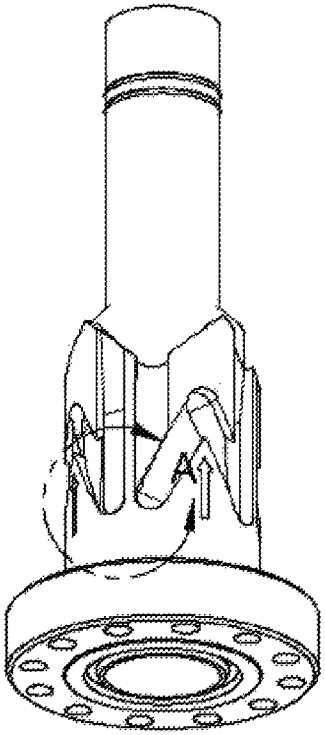
FIG. 9D is a perspective view showing the vertically lower most segment of the cam groove along the disconnection segment.
Figure 10C:
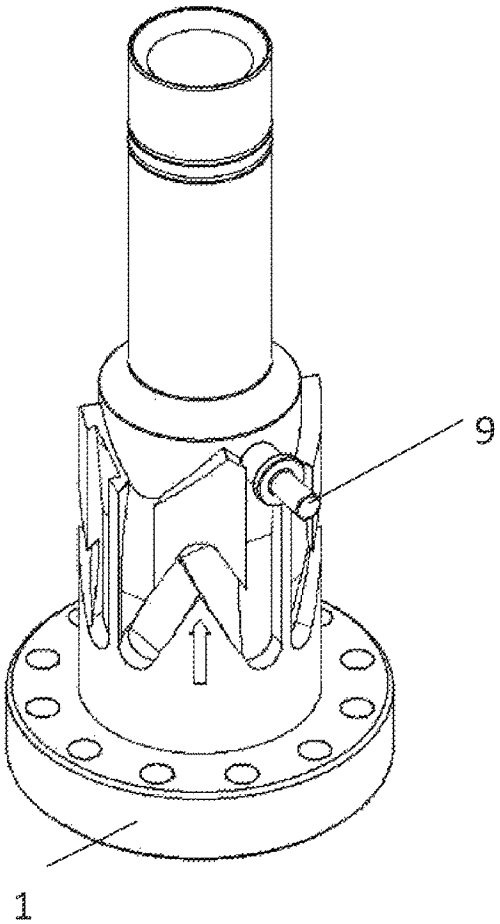
FIGS. 10A through 10C are perspective assembly views illustrating the vertical upward sequential movement of the locking pin along the cam groove during the "exit" phase of disconnection.
Figure 10B:
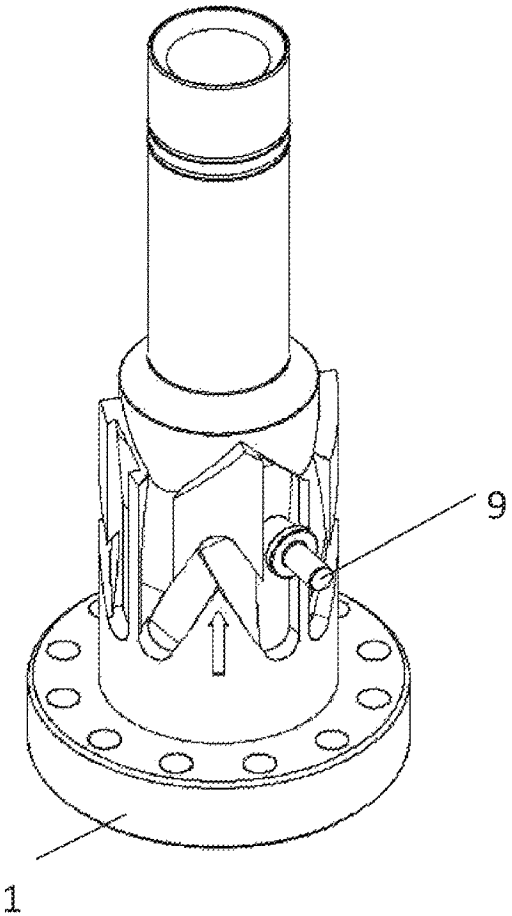
Figure 10A:
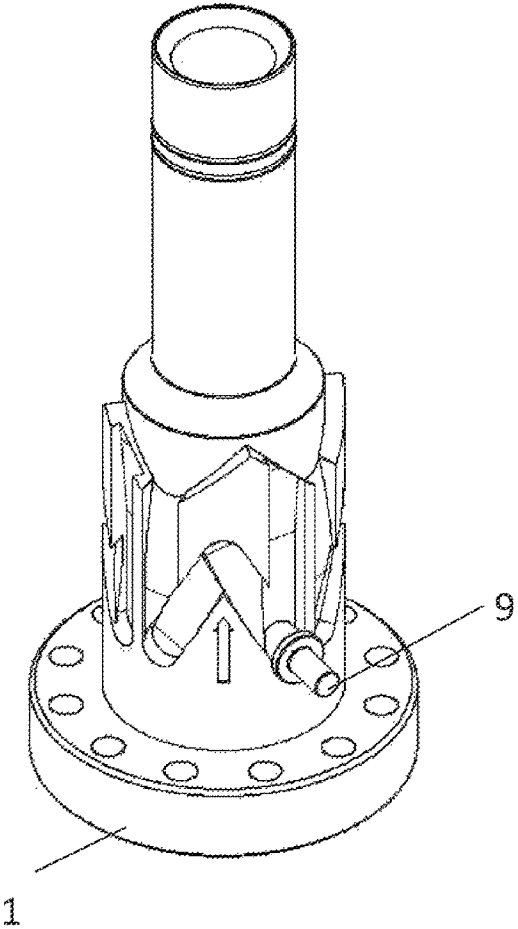
Figure 10E:
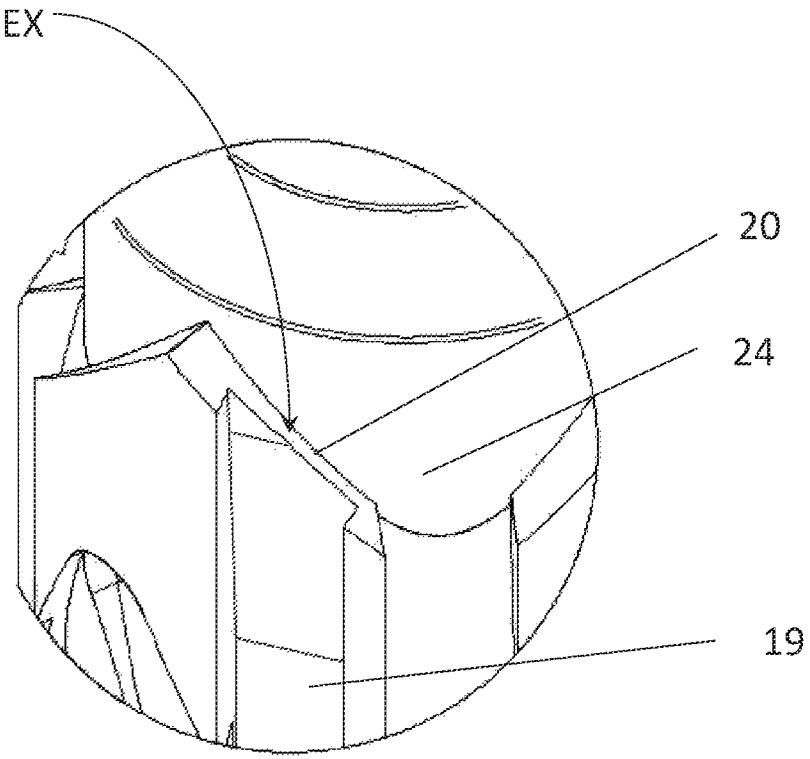
FIG. 10E is an enlarged view of detail A in FIG. 10D.

FIGS. 9A through 9C illustrate the interaction between locking pin 9 and the cam groove 3 as the disconnection process of the first lower and upper assemblies 1, 2 begins. When disconnection between the upper and lower assemblies 1, 2 is desired, the crane operator again lowers second upper assembly 2. As this occurs, the second step 16 causes the locking pins 9 to follow along the third cam segment 17 of the cam groove 3, downward and toward the right, as shown in FIGS. 9A-9C, toward the beginning of the fourth cam segment 19. The interaction of the second step 16 of cam groove 3 and the constant radial inward force on the locking pin 9 cause the locking pin 9 to travel along the fourth cam segment 17 rather than travel back in the direction toward the beginning of the second cam segment 15 of the cam groove 3. FIG. 9D shows the detail of cam groove 3 of at the end of the third cam segment 17 and the beginning of the fourth cam segment 19. As shown, a third step 18, e.g., a radially inward step of between 1/16 to 1 inch or so and more preferably a step of about ½ of an inch, is located at the transition between the end of the third cam segment 17 and the beginning of the fourth cam segment 19 of the cam groove 3. That is, the end of the third cam segment 17, adjacent the beginning of the fourth cam segment 19, is located radially further away from the central axis CA than the beginning of the fourth cam segment 17 so as to form a step therebetween. As soon as the locking pin 9 is completely located within the beginning of the fourth cam segment 19, the spring 10 forces the locking pin 9 radially inward a small distance, e.g., the thickness of the third step 18. As a result of this, the third step 18 now prevents the locking pin 9 from again following along the third cam segment 17 of the cam groove 3. As such, the third step 18 functions to prevent the respective locking pin 9 from retracing its path upward along the third cam segment 17 of the cam groove 3. Accordingly, when the crane again exerts a lifting force on the second assembly 2, the locking pin 9 will thus be forced to travel upward and follow along the fourth cam segment 19 of the cam groove 3 until the locking pin 9 eventually reaches position the position shown in FIG. 10C, before exiting the cam groove 3. That is, the third step 18 ensures, as soon as the locking pin 9 completely transitions into the fourth cam segment 19, that any subsequent upward force, from the crane, will cause locking pin 9 to travel along the fourth cam segment 19 of the cam groove 3 to the position shown in FIG. 10C and not back toward the position shown in FIG. 7C. FIGS. 10A through 10C Illustrate the interaction between the locking pin 9 and the cam groove 3 as the disconnection process is completed. Once the second upper assembly 2 is lowered until the second upper assembly 2 either partially or fully rests on the wellhead, the crane then operator exerts a force which again lifts the second upper assembly 2, relative to the first lower assembly 1, to facilitate complete disengagement of the second upper assembly 2 from the first lower assembly 1.

Figure 10D:
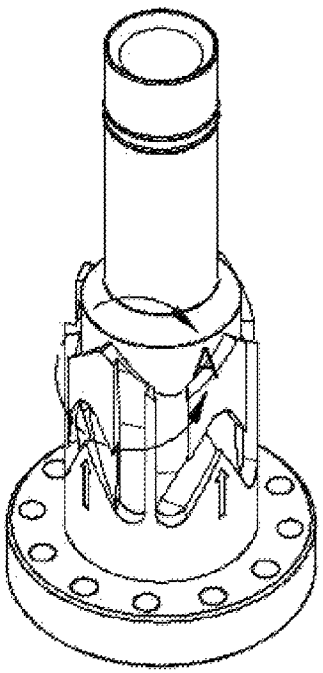
FIG. 10D is a perspective view showing the step formed between the exit region of the cam groove and the pin guiding surfaces.

FIG. 10D illustrates the geometry of cam groove 3 such that the cam groove 3 will allow the second upper assembly 2 to be removed from the first lower assembly 1. As the second upper assembly 2 is lifted, the locking pin 9 will move toward the end of the fourth cam segment and eventually transition or step over the fourth step 20, e.g., a radially inward step of between 1/16 to 1 inch or so and more preferably a step of about ½ of an inch, from the end of the fourth cam segment 19 back to the cylindrical surface 24 which is located radially closer to the central axis A. As soon as the locking pin 9 transitions over the fourth step 20, the fourth step 20 with, thereafter, prevent the locking pin 9 from traveling back along the fourth cam segment 19 toward the lower most position shown in FIG. 9C. Because of fourth step 20 and the fact that locking pins 9 are radially forced inward, any subsequent lowering of second upper assembly 2 would cause locking pin 9 to be guided toward the entrance EN of the cam groove 3, as shown in FIG. 4A, and thereby prevent the locking pin 9 from travelling back through the exit EX of the cam groove 3 and toward the position shown in FIG. 10A. Thus, through this series of (e.g. four) cam segments 13, 15, 17, 19, with a step 14, 16, 18, 20 being formed between the end of one segment and the beginning of the next segment, the locking pins are forced to travel along the respective cam groove 3 along a single direction of travel. As a result, a first cycle of downward and upward motion of the second upper assembly 2, relative to the first lower assembly 1, will advance locking pins 9 into their locked positions (see FIG. 7C), and a subsequent second cycle of downward and upward motion of the second upper assembly 2, relative to first lower assembly 1, will advance locking pins 9 into their unlocked position in which the second upper assembly 2 can be removed and separated from the first lower assembly 1.

Figure 11:
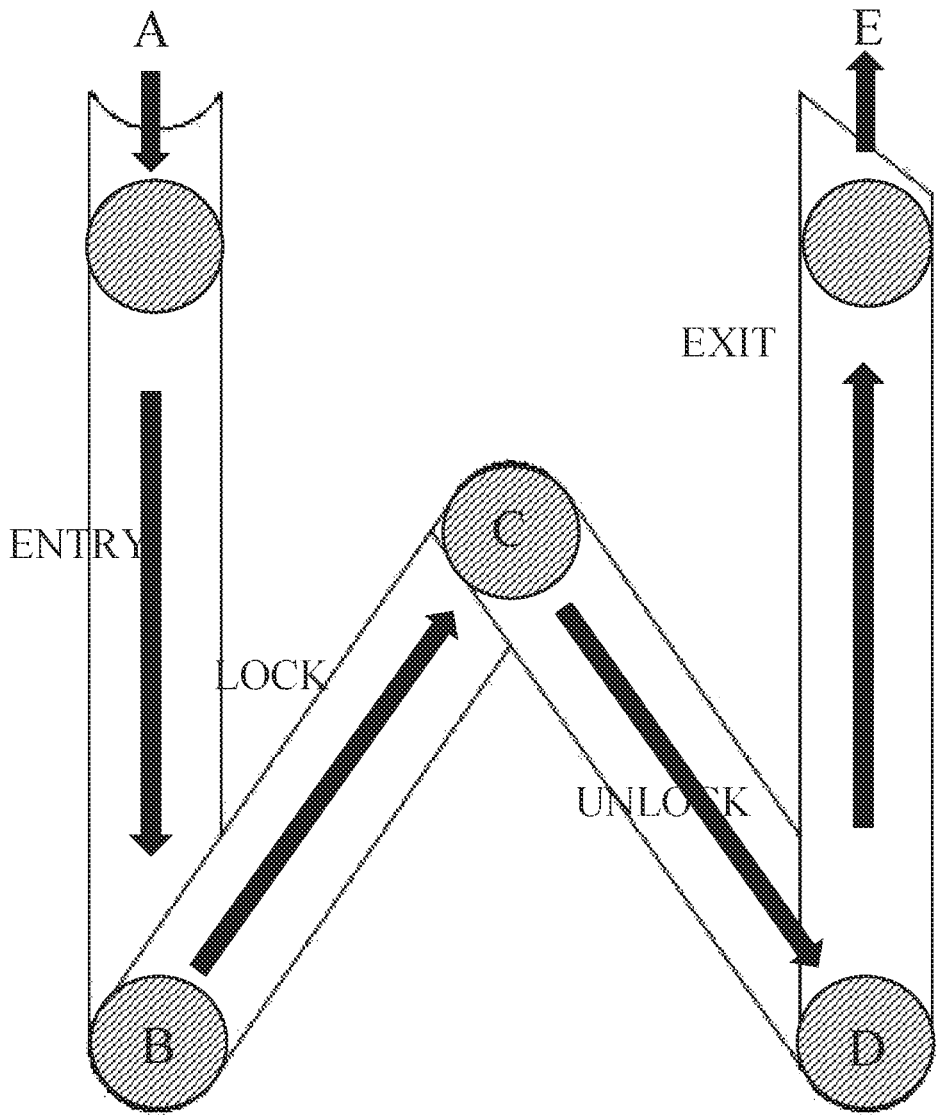
FIG. 11 is a diagrammatic view of showing the movement path followed by each locking pin to connect and disconnect the pressurizable assembly, in which each respective locking pin enters at position A and is induced to travel vertically downward toward position B and then induced to move toward the locked position indicated by position C, and disconnected when each respective locking pin is induced to travel from position C toward position D and then induced to move to position E where the locking pin exits from the cam groove.

FIG. 11 shows the relative motion of a single locking pin 9 along and through a single cam groove 3 to further illustrate the principle of the coupling mechanism of the present invention. As the second upper assembly 2 is lowered, relative to the first lower assembly 1, each one of the locking pins 9 will be guided into the entry EN and then travel from position A to position B in the direction of the arrow labelled ENTRY. Position B is the lowest point of the lock phase. When the second upper assembly 2 is then lifted, as noted above, due to the transition of the locking pin 9 over the first step 13, the locking pin 9 cannot travel back along the first cam segment 13 toward the entry EN and is thus forced to travel in the only possible direction—that is in the direction of the arrow labelled LOCK until the respective locking pin 9 reaches position C which is the locked position. At this point, any further upward force on second upper assembly 2 will not cause any relative movement between locking pin 9 and the respective cam groove 3, it will simply result in axial load being transferred to the first lower assembly 1. Since, at position C, the depth of the UNLOCK groove is greater than the depth of the LOCK groove, any subsequent lowering of the second upper assembly 2 cannot result in locking pin 9 traveling back in the LOCK direction. When second upper assembly 2 is lowered, locking pin 9 must advance in the direction of the arrow marked UNLOCK until the locking pin 9 reaches position D which is the lowest point of the unlock phase. At position D, the locking pin 9 again experiences a step change in the depth of cam groove 3 which will not permit the locking pin 9 to travel back in the UNLOCK direction. Subsequent upward force on second upper assembly 2 will result in locking pin 9 traveling along the only possible direction which is in the direction of the arrow marked EXIT. Further upward motion of second upper assembly 2 will result in locking pin 9 travelling all the way out of cam groove 3 ultimately resulting in complete decoupling of the second upper assembly 2 from the first lower assembly 1.

Figure 12:
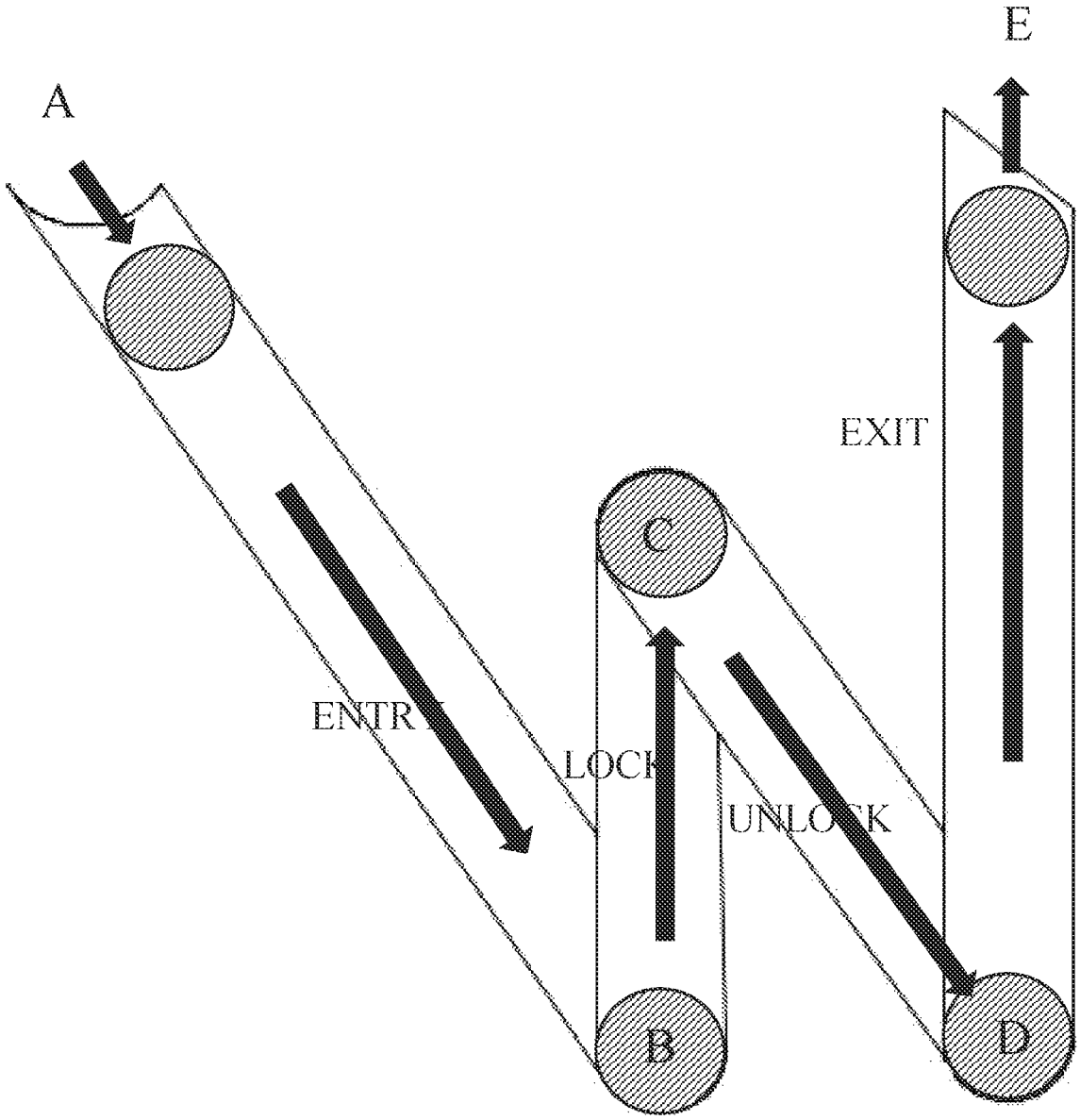
FIG. 12 is a diagrammatic perspective view of an alternate cam path configuration.

Now turning to FIG. 12, another possible geometry for the cam groove 3 is diagrammatically shown. FIG. 12, shows the relative motion of a single locking pin 9 through a single cam groove 3 to again illustrate the coupling mechanism of the present invention. The movement of the locking pin 9 is substantially the same as described above while following the cam groove which has a different shape. As the second upper assembly 2 is lowered relative to the first lower assembly 1, each of the locking pins 9 will be guided into the entry EN and travel from position A toward position B in the direction of the arrow labelled ENTRY. Position B is the lowest point of the lock phase. When second upper assembly 2 is then lifted, as noted above, due to the transition of the locking pin 9 over the first step 13, the locking pin 9 cannot travel back along the first cam segment 13 toward the entry EN and is thus forced to travel in the only possible direction—that is in the direction of the arrow labelled LOCK—until the locking pin 9 reaches position C which is the locked position. At this point, any further upward force on the second upper assembly 2 will not cause any relative movement between the locking pin 9 and the cam groove 3, it will simply result in the axial load being transferred to first lower assembly 1. Since, at position C, the depth of the UNLOCK groove is greater than the depth of the LOCK groove, any subsequent lowering of the second upper assembly 2 cannot result in the locking pin 9 traveling back in the LOCK direction. When second upper assembly 2 is again lowered, the locking pin 9 must advance in the direction of the arrow marked UNLOCK until the locking pin 9 reaches position D which is the lowest point of the unlock phase. At position D, the locking pin 9 again experiences a step change in the depth of cam groove 3 which will not permit the locking pin 9 to travel back in the UNLOCK direction. Subsequent upward force on second upper assembly 2 will result in locking pin 9 traveling along the only possible direction which is in the direction of the arrow marked EXIT. Further upward motion of the second upper assembly 2 will result in the locking pin 9 travelling all the way out of the cam groove 3 ultimately resulting in complete decoupling of second upper assembly 2 from the first lower assembly 1.

Figure 13:
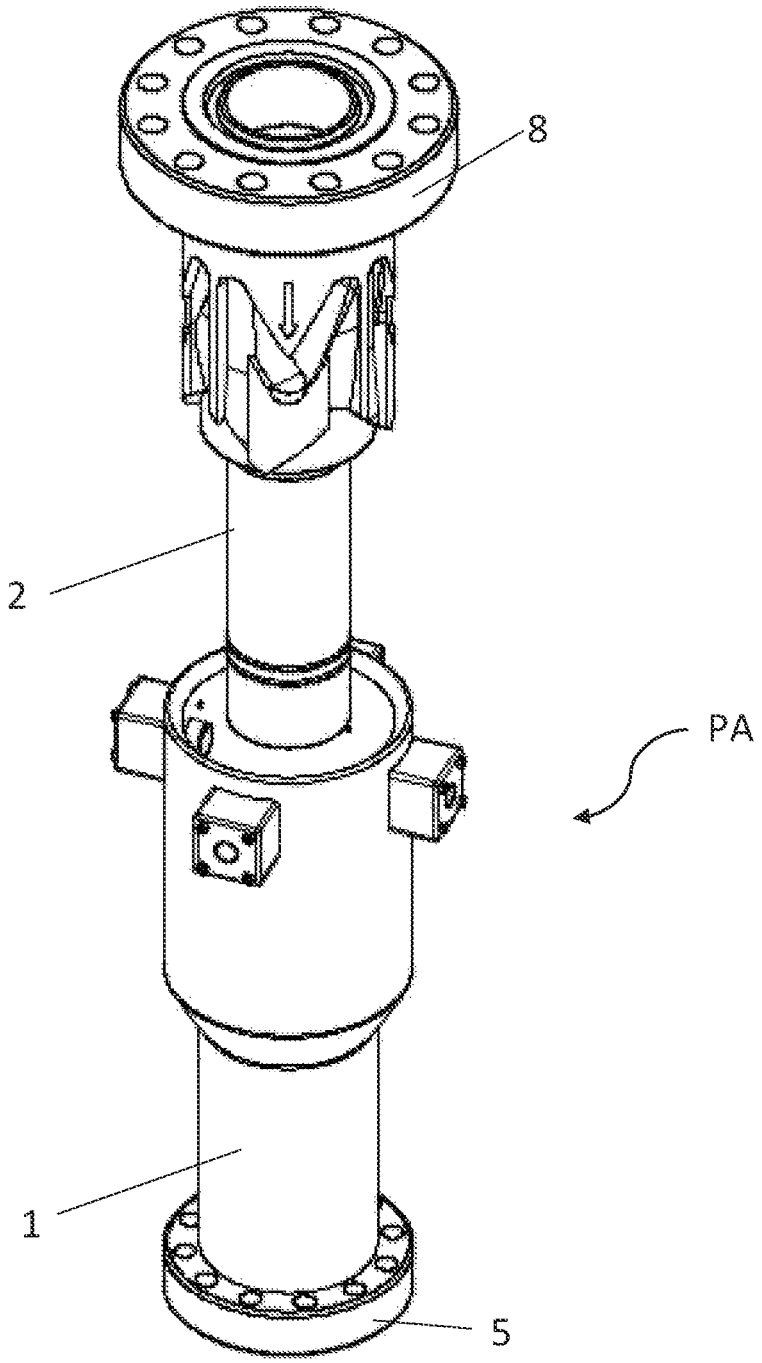
FIG. 13 shows an alternative arrangement in which the first lower fitting/assembly carries the locking pins which the second upper fitting/assembly carries the cam grooves.

Turning now to FIG. 13, a second embodiment of the present invention will now be briefly described. This embodiment is very similar to the previously discussed embodiment with the features of the second upper assembly 2 and the first lower assembly 1 being reversed. This embodiment is meant to illustrate that the present invention will function in the same manner regardless of which features remain stationary on first lower assembly which is affixed to the wellhead and which features are attached to second upper assembly which is moved by the moving crane.

It should be noted that the specific geometry of the cam groove 3 in the embodiment pictured in FIGS. 1 through 13 are not an exhaustive description of the possible geometries of the present invention. Other alterations would still be considered to be within the spirit and scope of this invention provided they act as a mechanism that allows for a cycle of lowering and raising the second upper fitting/assembly 2, relative to the first lower fitting/assembly 1, to lock the two fittings/assemblies to one another so as to withstand the internal pressure and axial load of the maximum allowable working pressure, and that a subsequent lowering and raising cycle would allow for complete separation of the two fittings/assemblies from one another.

It should also be noted that as the second upper assembly 2 is lowered by the crane, it will experience some degree of angular displacement as the locking pins travel through cam groove 3, however this is ancillary motion and is not induced so as to create the fluid seal. All that is required for the present invention to achieve a coupled and decoupled state is the downward force of gravity and the upward force of the lifting equipment.

Finally, it should be noted that the pictured embodiments illustrate the present invention with four locking pin mechanisms carried by one fitting/assembly and four corresponding cam grooves carried by the other fitting/assembly, however other embodiments could be devised with more or less features so long as the device provides adequate mechanical strength when the fittings/assemblies are coupled to one another to safely withstand the maximum allowable working pressure.

Generally each one of the first, the second, the third and the fourth cam segments are slightly inclined cam surfaces which are interconnected with, but separated one another by a respective step so as to form a continuous cam groove that defines a single direction of travel for the locking pin through the cam groove. This arrangement ensures that the first and second assemblies 1, 2 are consistently and reliably connected to one another by a simple downward lowering and then an upward lifting movement of the second upper assembly 2 relative to the first lower assembly 1. This arrangement also ensures that the first and second assemblies 1, 2 are consistently and reliably disconnected to one another by a simple downward lowering and then an upward lifting movement of the second upper assembly 2 relative to the first lower assembly 1. As shown, each one of the plurality of spaced apart cam grooves of the first assembly generally has a "W" shaped configuration from the entrance to the exit.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

Wherefore, I claim:

1. A pressurizable assembly for facilitating the flow of a fluid from a wellhead to pressurized equipment and vice versa, the pressurizable assembly comprising:

a first assembly having a wellhead connection member which facilitates a releaseable connection with the wellhead, and the first assembly defining a first assembly fluid passageway axially through the first assembly;

a second assembly having an equipment connection member which facilitates a releaseable connection with the pressurized equipment, and the second assembly defining a second assembly fluid passageway axially through the second assembly;

the first assembly carrying one of:

1) at least one spring loaded locking pin, or 2) at least one cam groove defining a one way passageway for the locking pin through the cam groove, while the second assembly carrying the other of:

1) the at least one spring loaded locking pin and 2) at least one the cam groove defining a one way passageway for the locking pin though the cam groove;

when the first assembly engages with the second assembly, by a relative downward movement of the second assembly relative to the first assembly to a lower most position then followed by a relative upward movement, the at least one locking pin follows the at least one cam groove in a first direction and the first and the second assemblies become locked to one another and the first assembly fluid passageway and the second assembly fluid passageway form a fluid-tight seal therebetween which permits the flow of the fluid between the wellhead and the pressurized equipment; and when the second assembly is subsequently moved, downward and then upward, relative to the first assembly, the at least one locking pin continues following the at least one cam groove in the first direction and the first and the second assemblies become disengaged and separated from one another.

2. A pressurizable assembly comprising:

a first assembly and a second assembly which, when assembled with one another, form the pressurizable assembly;

the first assembly having a tubular section, at a first end thereof, for mating with an inwardly facing surface of the second assembly and a connection member, at a second end thereof, for connecting the first assembly to a wellhead;

the connection member, the first assembly, and the tubular section of the first assembly having an opening extending therethrough which permits a flow of fluid;

the first assembly having a plurality of spaced apart cam grooves formed in an exterior surface thereof;

the second assembly comprising a hollow housing which has an internal diameter which is size and shaped to intimately receive and mate with the tubular section of the first assembly and at least partially surround the plurality of spaced apart cam grooves of the first assembly;

one of the first assembly and the second assembly supporting at least one elastomeric seal for forming a seal therebetween when the first assembly and the second assembly engage with one another;

the second assembly having a connection member which facilitates connection of the second assembly to a desired piece of pressure equipment, and the second assembly having a plurality of locking pin mechanisms which are each located to interact respectively with one of the plurality of spaced apart cam grooves of the first assembly;

the connection member of the second assembly and the hollow housing having an opening extending therethrough which permits a flow of fluid; and axially movement of the second assembly, toward and away from the first assembly, causing each of the plurality of locking pin mechanisms to follow along a respective one of the plurality of spaced apart cam grooves to an intermediate locking position which connects the second assembly to the first assembly, while a subsequent axially movement of the second assembly, toward and away from the first assembly, causing each of the plurality of locking pin mechanisms to follow along a respective one of the plurality of spaced apart cam grooves to a release position which permits the second assembly to disconnect from the first assembly.

3. The pressurizable assembly according to claim 2, wherein each the locking pin mechanism comprises a pin housing which accommodates a locking pin and a compression spring, and the compression spring biases the locking pin radially inward for engagement with one of the plurality of spaced apart cam grooves of the first assembly.

4. The pressurizable assembly according to claim 3, wherein plurality of spaced apart cam grooves comprises four cam grooves and the plurality of radially mounted locking pins mechanism comprise four locking pin mechanisms.

5. The pressurizable assembly according to claim 3, wherein when a rear surface of each locking pin is generally fully retracted into the locking pin housing, and thus generally not visible to an operator, and this provides visual feedback to the operator that the locking pin mechanism is fully engaged and locked.

6. The pressurizable assembly according to claim 3, wherein the first assembly has a cylindrical surface and a pair of V-shaped pin guide surfaces which assist with directing and channeling each of the locking pins toward a respective entrance of one of the plurality of cam grooves.

7. The pressurizable assembly according to claim 2, wherein each of the plurality of spaced apart cam grooves of the first assembly having an entrance and an exit, and the intermediate locking position is located between the entrance and the exit.

8. The pressurizable assembly according to claim 7, wherein each of the plurality of spaced apart cam grooves of the first assembly comprises a first cam segment, a second cam segment, a third cam segment and a fourth cam segment which are sequentially arranged and interconnected with one another between the entrance and the exit.

9. The pressurizable assembly according to claim 8, wherein each of the first cam segment, the second cam segment, the third cam segment and the fourth cam segment are stepped segments which assist with guiding the respective locking pin mechanism from the entrance toward the exit during the relative axial movement of the second assembly toward and away from the first assembly.

10. The pressurizable assembly according to claim 9, wherein each step of the first cam segment, the second cam segment, the third cam segment and the fourth cam segment is between 1/16 to 1 inch.

11. The pressurizable assembly according to claim 8, wherein each one of the first cam segment, the second cam segment, the third cam segment and the fourth cam segment are inclined cam surfaces which are interconnected with, but separated from, one another by a respective step so as to form a continuous cam groove that defines a single direction of travel for the respective locking pin mechanism.

12. The pressurizable assembly according to claim 2, wherein each of the plurality of spaced apart cam grooves of the first assembly has a generally W-shaped configuration.

13. A method of repeatedly attaching and detaching a pressurizable assembly to facilitate flow of a fluid from a wellhead to pressurized equipment and vice versa, the method comprising:

providing a first assembly, having a wellhead connection member, which facilitates a releaseable connection of the first assembly with the wellhead;

providing a second assembly, having an equipment connection member, which facilitates a releaseable connection of the second assembly with pressurized equipment;

forming one of:

1) at least one locking pin, or 2) at least one cam groove defining a one way passageway, for the at least one locking pin, through the at least one cam groove from a cam groove entrance, which is open to receive the at least one locking pin, to a cam groove exit, which is also open to allow exit of the at least one locking pin, on the first assembly;

forming the other of:

1) at least one locking pin, or 2) at least one cam groove defining a one way passageway, for the at least one locking pin, through the at least one cam groove from a cam groove entrance, which is open to receive the at least one locking pin, to a cam groove exit, which is also open to allow exit of the at least one locking pin;

on the second assembly;

engaging the first assembly with the second assembly, via a relative downward movement of the second assembly relative to the first assembly to a lower most position then followed by a relative upward movement, so that the at least one locking pin enters the at least one open cam groove entrance and follows the one way passageway of the at least one cam groove in a first direction to an intermediate locking position of the one way passageway so that the first and the second assemblies become locked to one another, and disengaging the first assembly from the second assembly when the second assembly is subsequently moved, downward and then upward, relative to the first assembly, so that the at least one locking pin continues following the one way passageway of the at least one cam groove in the first direction and exits from the at least one cam groove, via the cam groove exit, so that the first and the second assemblies become disengaged and separated from one another.

* * * * *